US006500050B2

(12) United States Patent
Walch et al.

(10) Patent No.: US 6,500,050 B2
(45) Date of Patent: Dec. 31, 2002

(54) HIGH PRECISION ABRASIVE FLOW MACHINING APPARATUS AND METHOD

(75) Inventors: William L. Walch, Greensburg, PA (US); John M. Greenslet, Irwin, PA (US); Edward J. Rusnica, Jr., Irwin, PA (US); Ruth S. Abt, Duquesne, PA (US); Lawrence J. Voss, New Kensington, PA (US)

(73) Assignee: Extrude Hone Corporation, Irwin, PA (US)

( * ) Notice: Subject to any disclaimer, the term of this patent is extended or adjusted under 35 U.S.C. 154(b) by 0 days.

(21) Appl. No.: 09/931,204

(22) Filed: Aug. 16, 2001

(65) Prior Publication Data

US 2002/0028633 A1 Mar. 7, 2002

Related U.S. Application Data

(60) Provisional application No. 60/230,353, filed on Sep. 6, 2000.

(51) Int. Cl.[7] ..... B24C 1/00

(52) U.S. Cl. ..... 451/36; 451/61; 451/113; 451/446

(58) Field of Search ..... 451/36, 61, 104, 451/113, 446

(56) References Cited

U.S. PATENT DOCUMENTS

| | | | | |
|---|---|---|---|---|
| 3,521,412 A | | 7/1970 | McCarthy | 51/317 |
| 3,630,642 A | * | 12/1971 | Osterman | 417/245 |
| 3,728,821 A | * | 4/1973 | Perry | 451/36 |
| 4,005,549 A | * | 2/1977 | Perry | 451/36 |
| 5,054,247 A | | 10/1991 | Rhoades et al. | 51/317 |
| 5,070,652 A | | 12/1991 | Rhoades et al. | 51/7 |
| 5,125,191 A | | 6/1992 | Rhoades | 51/317 |
| 5,137,368 A | * | 8/1992 | Kistner | 366/272 |
| 5,367,833 A | | 11/1994 | Rhoades et al. | 451/104 |
| 5,494,102 A | * | 2/1996 | Schulte | 166/105.6 |
| 5,807,163 A | | 9/1998 | Perry | 451/36 |
| 6,132,482 A | | 10/2000 | Perry | 51/239 |
| 6,273,787 B1 | * | 8/2001 | Gilmore et al. | 4651/36 |

FOREIGN PATENT DOCUMENTS

| | | |
|---|---|---|
| SU | 51826 | 6/1976 |

* cited by examiner

*Primary Examiner*—Joseph J. Hail, III
*Assistant Examiner*—Hadi Shakeri
(74) *Attorney, Agent, or Firm*—Webb Ziesenheim Logsdon Orkin & Hanson, P.C.

(57) ABSTRACT

An apparatus and method for abrasive flow machining the orifice of a workpiece by using an abrasive media whereby the apparatus may accommodate abrasive media having a range of viscosities by modifying the diameters of pistons and cylinders in positive displacement pumps within the apparatus.

23 Claims, 17 Drawing Sheets

HIGH PRECISION ABRASIVE FLOW MACHINING APPARATUS AND METHOD

This application claims benefit of Ser. No. 60/230,353 filed Sep. 6, 2000.

BACKGROUND OF THE INVENTION

1. Field of the Invention

The invention is related to abrasive-flow machining and, more particularly, an abrasive-flow machining apparatus, capable of processing an orifice within a part by using either a high-viscosity media, a low-viscosity media, or a media having a viscosity therebetween. The invention is also directed to a method for such processing.

2. Description of the Related Art

Abrasive-flow machining is the process of polishing or abrading a workpiece by passing a viscous media having abrasive particles therein under pressure over the workpiece or through an orifice extending through the workpiece. For purposes of this discussion, media will be discussed as having high viscosity, in the range of between 150–1,000,000 centipoise and media having low viscosity, in the range of 1–150 centipoise. However, the distinction between low-viscosity and high-viscosity may not occur precisely at 150 centipoise and it should be appreciated that such a distinction is made to promote understanding of the subject invention. One example of high-viscosity media is a visco-elastic plastic media such as a semisolid polymer composition. One example of a low-viscosity media is a liquid abrasive slurry that includes abrasives suspended or slurried in fluid media such as cutting fluids of honing fluids. The fluid may have a rheological additive and finely divided abrasive particles incorporated therein. The rheological additive creates a thixotropic slurry.

In the past, abrasive-flow machining for high-viscosity media was performed using one type of abrasive-flow machine and abrasive-flow machining for low-viscosity media was performed utilizing an entirely different abrasive-flow machine.

In particular, high-viscosity media requires higher pressures for mixing and for flowing over or through a workpiece. Pressures in the range of 4,000 psi may be necessary for proper flow of high-viscosity media through the orifice of a workpiece. Additionally, high-viscosity media are typically thixotropic, which means the specific viscosity of the media is dependent upon the shear imparted to the media. In many applications, a pre-specified viscosity is required and, therefore, the high-viscosity media must be treated to satisfy that specific viscosity value. Conditioner stations accomplish this task by subjecting the high-viscosity media to shear until the desired viscosity is obtained. However, such desired viscosity may require pressures in excess of 800 psi to produce the desired shear and thereby obtain the desired viscosity.

Finally, the volume of high-viscosity media that must pass through the orifice of the workpiece to accomplish the desired result is typically less than the volume of low-viscosity media that may be passed through the same orifice to accomplish a desired result. Therefore, while high-viscosity media requires higher pressures for both conditioning the media and processing the workpiece, the volume of fluid necessary for such a task is less than for a low-viscosity media operation. It can then be appreciated that for a high-viscosity media, higher pressures and lower volumes dictate sizing of equipment in a specified manner.

On the other hand, when mixing and flowing a low-viscosity media, low pressures but high volumes are normally required. As an example, conditioning a low-viscosity media may be accomplished using pressures on the order of 150 psi, and such conditioning is intended to mix abrasive particles within the low-viscosity media to provide a homogenous mixture. Such low-viscosity conditioning is different from conditioning of high-viscosity media, which requires imparting shear to adjust the viscosity level of the media. Additionally, to force the low-viscosity media through the orifice of a workpiece, pressures on the order of 1,500 psi may be necessary.

When using a high-viscosity media to process the orifice of a workpiece, it has been found that accurate control of the volume of media through the orifice of the workpiece is a very effective manner of determining when the orifice has been sufficiently processed. This method may also be used for processing low-viscosity medium. Additionally, for low-viscosity media, the media may be applied to the orifice of a workpiece under constant pressure and the flow rate is monitored until a target flow rate is obtained, at which time the process is terminated. In the alternative, the media may be applied to the orifice of the workpiece at a fixed flow rate and the pressure monitored until a target pressure is obtained, at which time the process is terminated. Therefore, not only are the pressures and volumes different between low-viscosity and high-viscosity media processing, but the techniques for measuring and terminating these processes may also be different.

FIG. 1 illustrates a nozzle 1 having an orifice 2 extending through the wall 3 of the nozzle. The nozzle has a first end 4, and a second end 6. The orifice 2 has a wall 8 along its length. The behavior of high viscosity media when processing the orifice wall 8 is different than the behavior of low-viscosity media. In particular, both low-viscosity and high-viscosity media tend to condition the edges at the first end 4 of the orifice 2, while only high-viscosity media tends to polish the wall 8 from the first end 4 toward the second end 6. While a nozzle 1 having an orifice 2 will be used as an example for the method and apparatus described herein, it should be appreciated the subject method and apparatus may be applied to a wide variety of workpieces having orifices.

In many instances, an individual engaged in abrasive-flow machining has a need to process a part or parts using both high-viscosity media and low-viscosity media and, using the current technology, that user is forced to purchase two separate machines, one dedicated to high-viscosity media and the other dedicated to low-viscosity media. Not only does this contribute to expense, but it requires maintenance of two separate machines and consumes additional space on the factory floor. An abrasive-flow machining apparatus and method is desired to alleviate the need for two separate abrasive-machining apparatus for the use of high-viscosity media and low-viscosity media for processing a workpiece and to provide a single apparatus capable of using both, albeit one at a time, of either high-viscosity media or low-viscosity media for processing a workpiece.

BRIEF SUMMARY OF THE INVENTION

A first embodiment of the invention is a system for abrasive flow machining an orifice in a workpiece wherein the system is capable of using abrasive media having a range of viscosity values, wherein the system is comprised of:

- a processing station having a processing pump and a processing pump actuator to drive the pump, wherein the pump is supplied with media and wherein the pump forces media through the workpiece orifice to machine the orifice and wherein the pump is adapted to accommodate one of either a primary processing piston and a primary processing cylinder, wherein the primary processing piston has a diameter and wherein the primary processing piston is slidingly positioned within a primary processing cylinder or an alternate processing piston and an alternate processing cylinder, wherein the alternate processing piston has a diameter different than the primary processing piston diameter and wherein the alternate processing piston is slidingly positioned within an alternate processing cylinder, and wherein the processing pump may utilize the primary processing piston and primary processing cylinder for pumping a low viscosity media through the orifice and may utilize the alternate processing piston and alternate processing cylinder for pumping a higher viscosity media through the orifice.

A second embodiment of the invention is a method of modifying a device used for abrasive flow machining with an abrasive media having a viscosity for forcing the media through an orifice of a workpiece, wherein the device has a processing station comprised of a processing pump and a processing pump actuator and wherein the processing pump has a primary processing pump cylinder and a primary processing pump piston with a primary diameter slidably within the primary cylinder for forcing the media from the processing station into the orifice, wherein the method is comprised of the step of modifying the diameter of the primary processing pump piston cylinder and the primary processing piston to accommodate media of different viscosities.

A third embodiment of the invention is a system for abrasive flow machining an orifice of a workpiece, wherein the system has a processing station for introducing media through an orifice in a workpiece;

a return station, wherein the return station has a double acting piston and the piston is comprised of a return piston slidable within a return piston cylinder, wherein the piston cylinder with the piston in a retracted position accepts media discharged from the processing station and wherein the piston in the extended position forces media from the return station; and wherein the piston has a rod attached thereto and each of the piston and the rod have a bore extending therethrough such that when the piston is urged toward the extended position, media is forced through the bore and is directed toward the processing station.

DETAILED DESCRIPTION OF THE INVENTION

Figure 2:
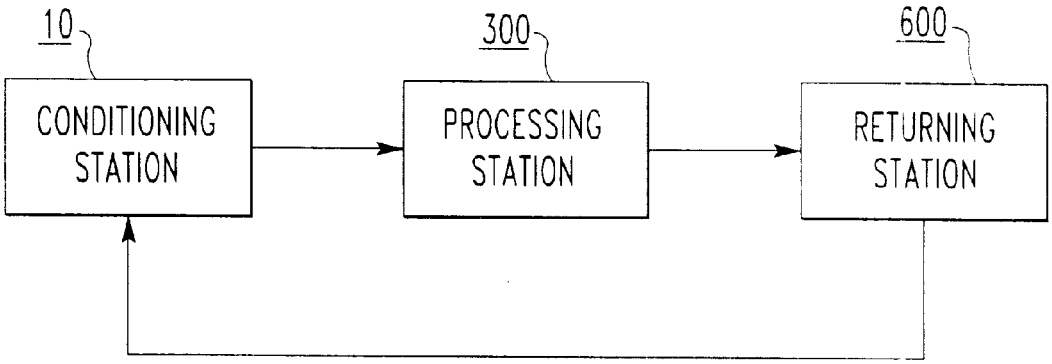
FIG.2 PRIOR ART
FIG. 2 is a simplified process diagram, illustrating the path of the media involved in processing a workpiece.

FIG. 2 is a process diagram, generally indicating the path an abrasive-flow media travels during the processing of a workpiece. In particular, the abrasive-flow media is conditioned in a conditioning station 10 which, as previously mentioned, may involve either imparting shear to a high-viscosity media, thereby adjusting the viscosity and providing for a homogeneous media or, in the alternative, thoroughly mixing abrasive particles in the low-viscosity media to provide a homogeneous mixture. The conditioned media is then introduced to a processing station 300 where it is delivered under pressure to the workpiece. Once the media has passed through the workpiece it is returned through the returning station 600 to conditioning station 10.

Figure 3:
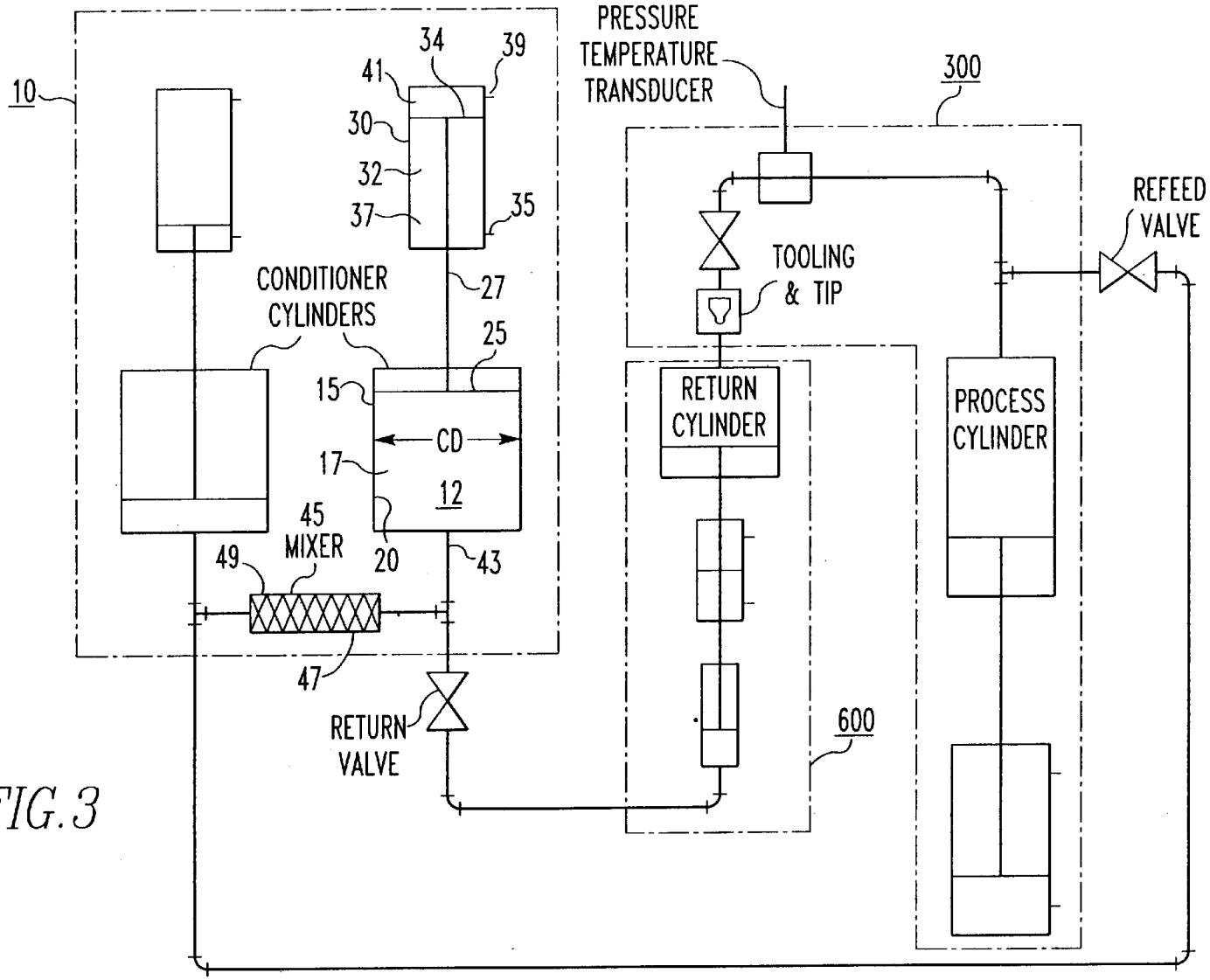
FIG. 3 is a schematic drawing of the abrasive-flow machining apparatus and method, in accordance with the subject invention.

Directing attention to FIG. 3, a schematic of the abrasive-flow machining apparatus and method, in accordance with the subject invention, is shown.

The conditioning station 10 may be comprised of a first conditioning pump 12 comprised of a primary conditioning cylinder 15 and a primary conditioning piston 25. The primary conditioning cylinder 15 has an inner bore 17 with a cylinder wall 20. The inner bore has a diameter CD. The conditioning cylinder 15 houses the primary conditioning piston 25, having an attached piston rod 27, which is connected to a primary actuator 30. In one embodiment of the subject invention, the primary actuator 30 is comprised of an actuator cylinder 32 and a double-acting actuator piston 34, which may be reciprocated by hydraulic fluid introduced under pressure through a hydraulic line 35 to a first chamber 37 or through a hydraulic line 39 to a second chamber 41.

It should be noted that such an actuator cylinder 32, as discussed, is typical of other actuator cylinders to be discussed in accordance with the subject invention and, for that reason, details of such a hydraulically actuated cylinder will not be provided, with the understanding that this description is sufficient.

However, it should also be noted that the actuator cylinders, in accordance with the subject invention, should not be limited to those that are hydraulically actuated, but may also include electrically operated linear actuators. It should, furthermore, be appreciated that an abrasive-flow machining apparatus, in accordance with the subject invention, may have some actuators which are hydraulically operated and other actuators which are electrically operated.

Figure 4:
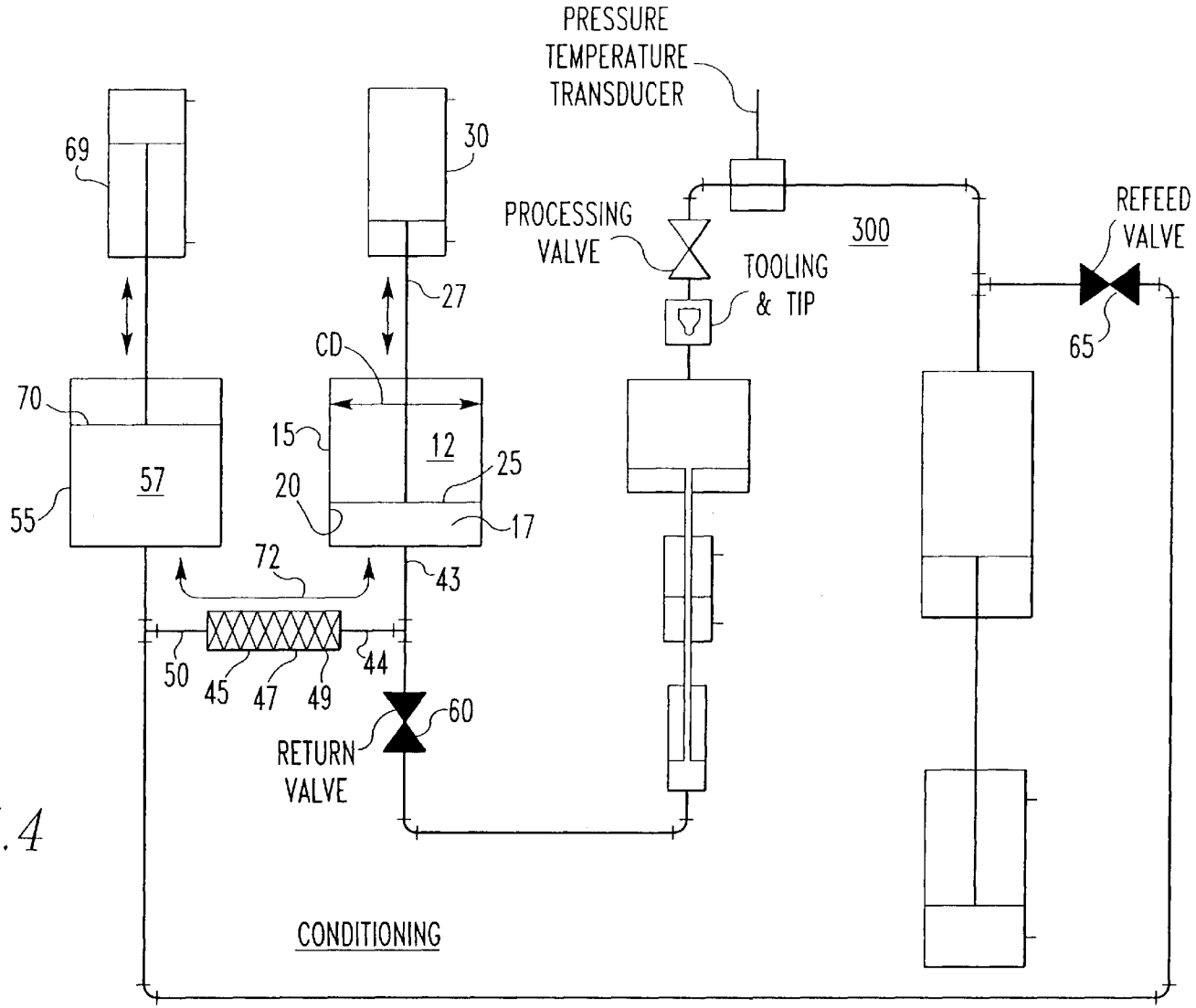
FIG. 4 is a schematic drawing of the conditioning mode, in accordance with the subject invention.

The inner bore 17 of primary conditioning cylinder 15 is filled with media, which for the purposes of this discussion, will be low-viscosity media. The primary conditioning piston 25 is then advanced within the primary conditioning cylinder 15, as illustrated in FIG. 4, such that the media within the primary conditioning cylinder 15 is forced through piping segment 43, piping segment 44 and into a mixer 45, which agitates the media to promote a homogeneous mixture of abrasive particles within the media. The mixer may be a vessel 47, comprised of one or more baffles 49 that force the media through a tortuous path to promote mixing. In the alternative, the mixer may be any static in-line mixer capable of mixing both low-viscosity and high-viscosity media. One such other example would be a vessel having cylinders within and angled holes extending through the cylinders to provide a tortuous path for the media. While dynamic mixers such as a propeller blade may be used, such a device would be more effective with low-viscosity media than with high-viscosity media. Upon exiting the mixer 45, the media may proceed through piping segment 50 and advance to the processing station 300 (FIG. 3). However, it may be desirable to permit the media, after it has passed through the mixer 45, to accumulate in a primary conditioning cylinder 55 of a second conditioning pump 57 operated by secondary actuator 69, having features similar to the first conditioning pump 12 previously described. It may be appreciated that, with return valve 60 and refeed valve 65 in closed positions, the primary conditioning piston 25 of the first conditioning pump 12 and the primary conditioning piston 70 of the second conditioning pump 57 may be operated in reciprocating fashions, such that the media passes back and forth within the mixer 45, as indicated by arrow 72.

Figure 5:
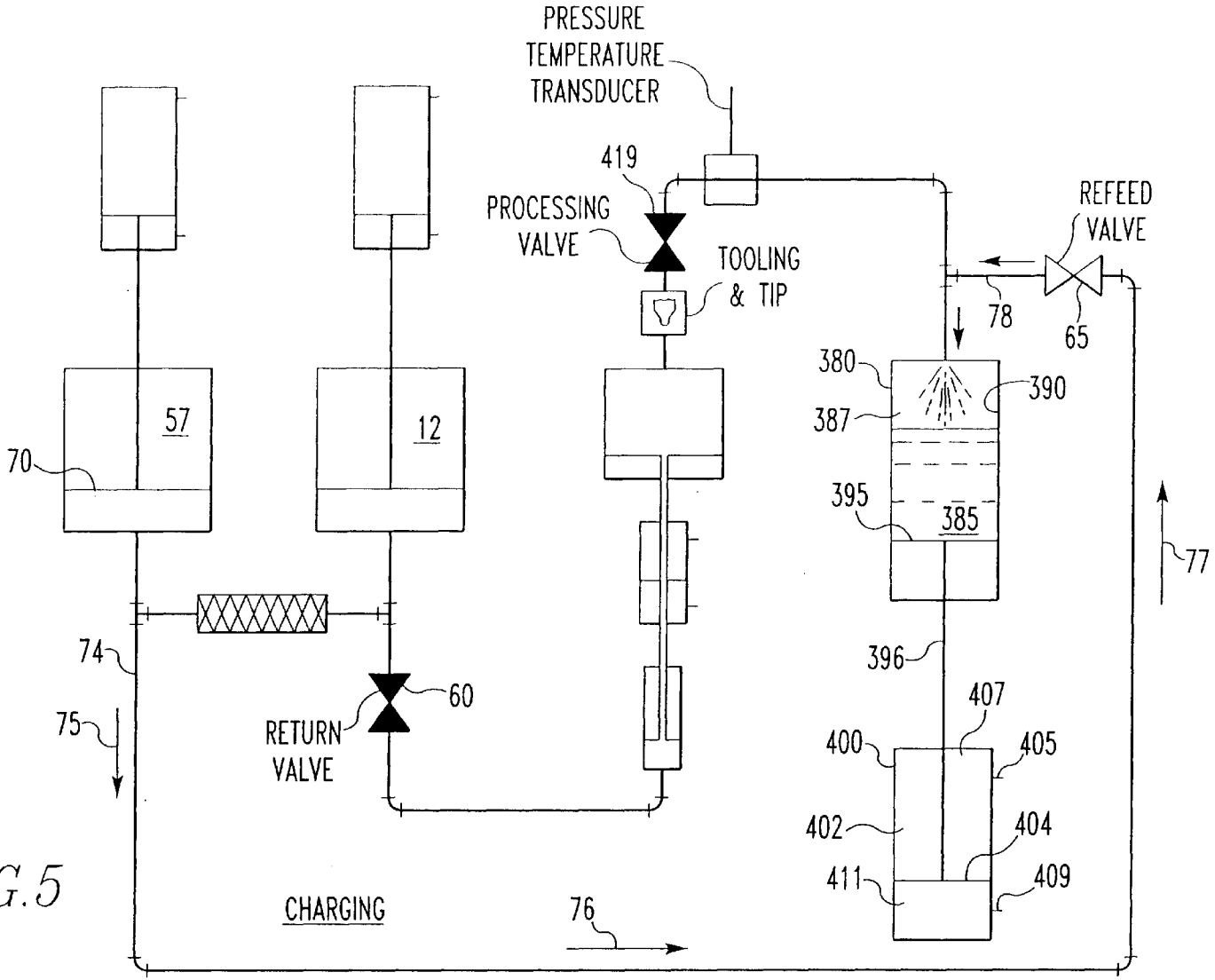
FIG. 5 is a schematic drawing of the charging mode, in accordance with the subject invention.

Directing attention to FIG. 5, once the media has been properly conditioned, the refeed valve 65 may be opened while the return valve 60 remains closed, and the processing valve 419 is closed, and primary conditioning piston 70 again advanced within the primary conditioning cylinder 55 of the second conditioning pump 57, thereby forcing the media through piping segment 74 in the direction of arrows 75, 76, 77 through the refeed valve 65 and into the primary processing cylinder 380 of the processing pump 385. The primary processing cylinder 380 is comprised of an inner bore 387, having a cylinder wall 390. A primary processing piston 395 extends within the bore 387, and a piston rod 396 is attached to the piston 395. The piston rod 396 is also connected to a processing actuator 400. The processing actuator 400 has an actuator cylinder 402 and an actuator piston 404 directly connected to the piston rod 396. Pressurized fluid is introduced through hydraulic line 405 into a first chamber 407 of the processing actuator 400 to move the actuator piston 404, and thereby primary processing piston 395, in one direction. Pressurized fluid is introduced through a second hydraulic line 409 into a second chamber 411 of the actuator cylinder 402 to displace the primary processing piston 395 in a second direction.

It should be appreciated that, while the media was shown as being introduced through the advancement of piston 70 of the second conditioning pump 57, it may also be possible to generate a vacuum using primary processing piston 395 of the primary processing pump 385, thereby moving the media from conditioning cylinder 55 to the primary processing cylinder 380. Once the primary processing cylinder 380 is filled with media, it is considered to be charged.

Figure 1:
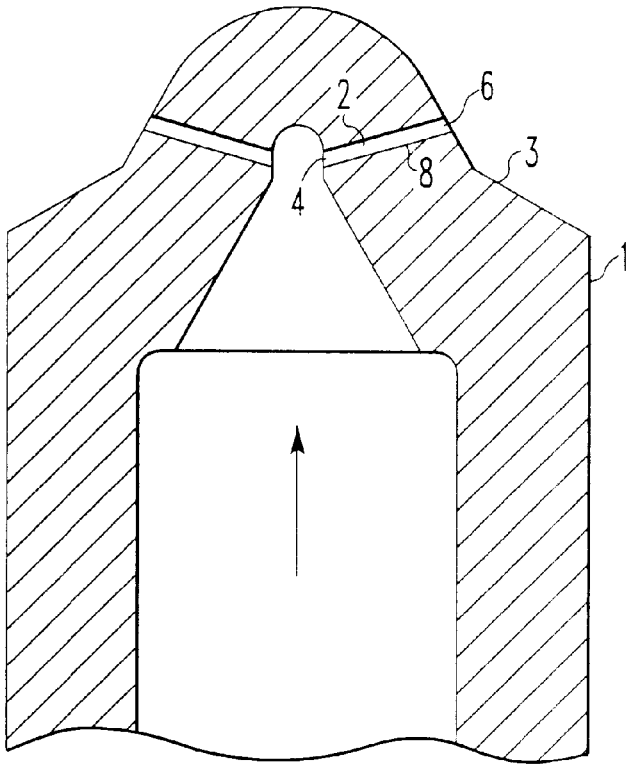
FIG.1 PRIOR ART
FIG. 1 is a section view of a typical nozzle that may be processed using either a high-viscosity media or a low-viscosity media.
Figure 6:
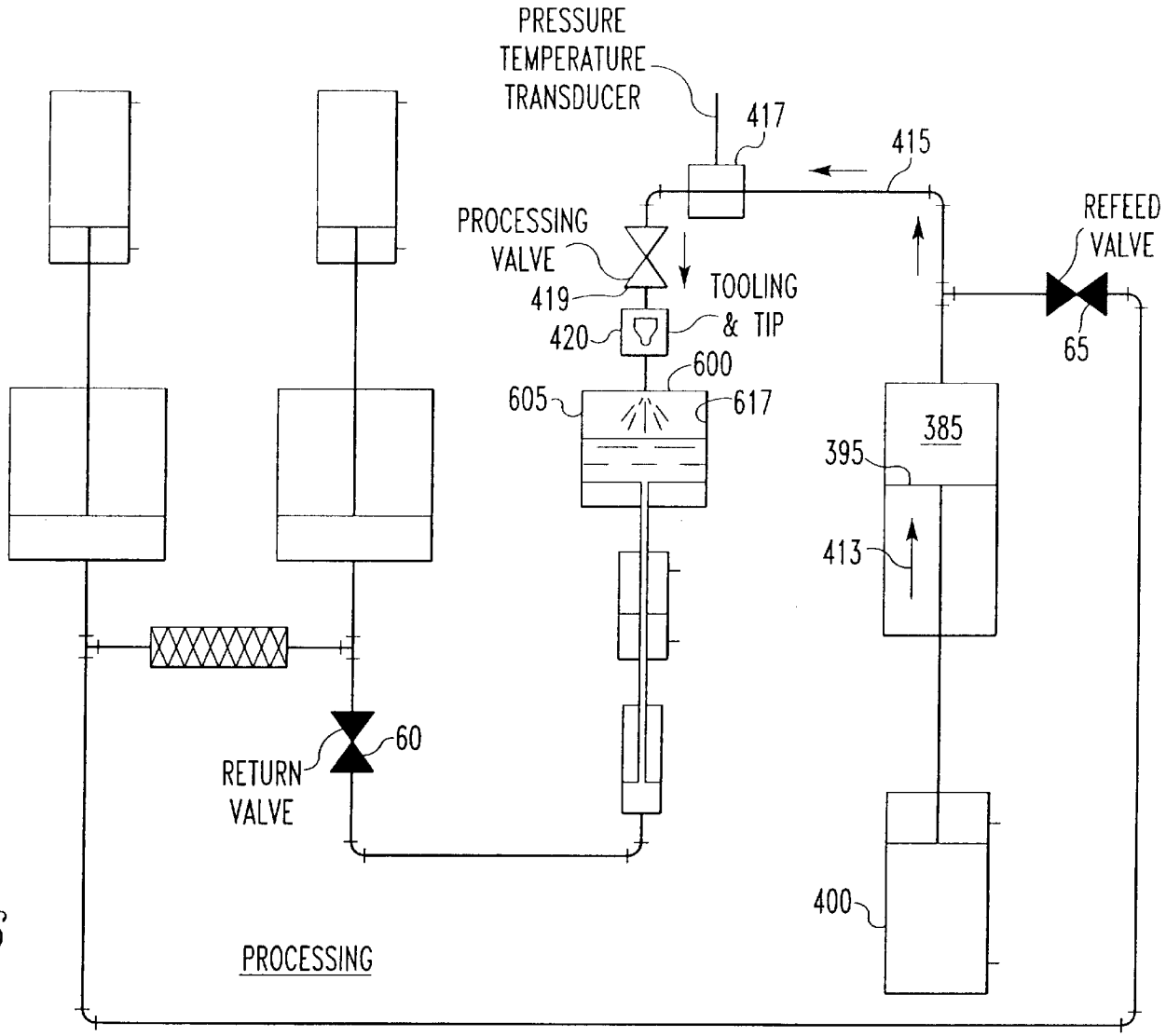
FIG. 6 is a schematic drawing of the processing mode, in accordance with the subject invention.

At this point, as illustrated in FIG. 6, with refeed valve 65 closed, the processing actuator 400 may be used to advance the piston 395, as indicated by arrow 413, thereby advancing media through piping segment 415 past a pressure and temperature transducer 417, past the processing valve 419, and through the orifice of a nozzle, which is the workpiece 420. The workpiece 420 may be similar to the nozzle 1, illustrated in FIG. 1. After the media has traveled through the orifice of the nozzle, it may be captured in a return cylinder 605 of the returning station 600 (FIG. 1).

Figure 7:
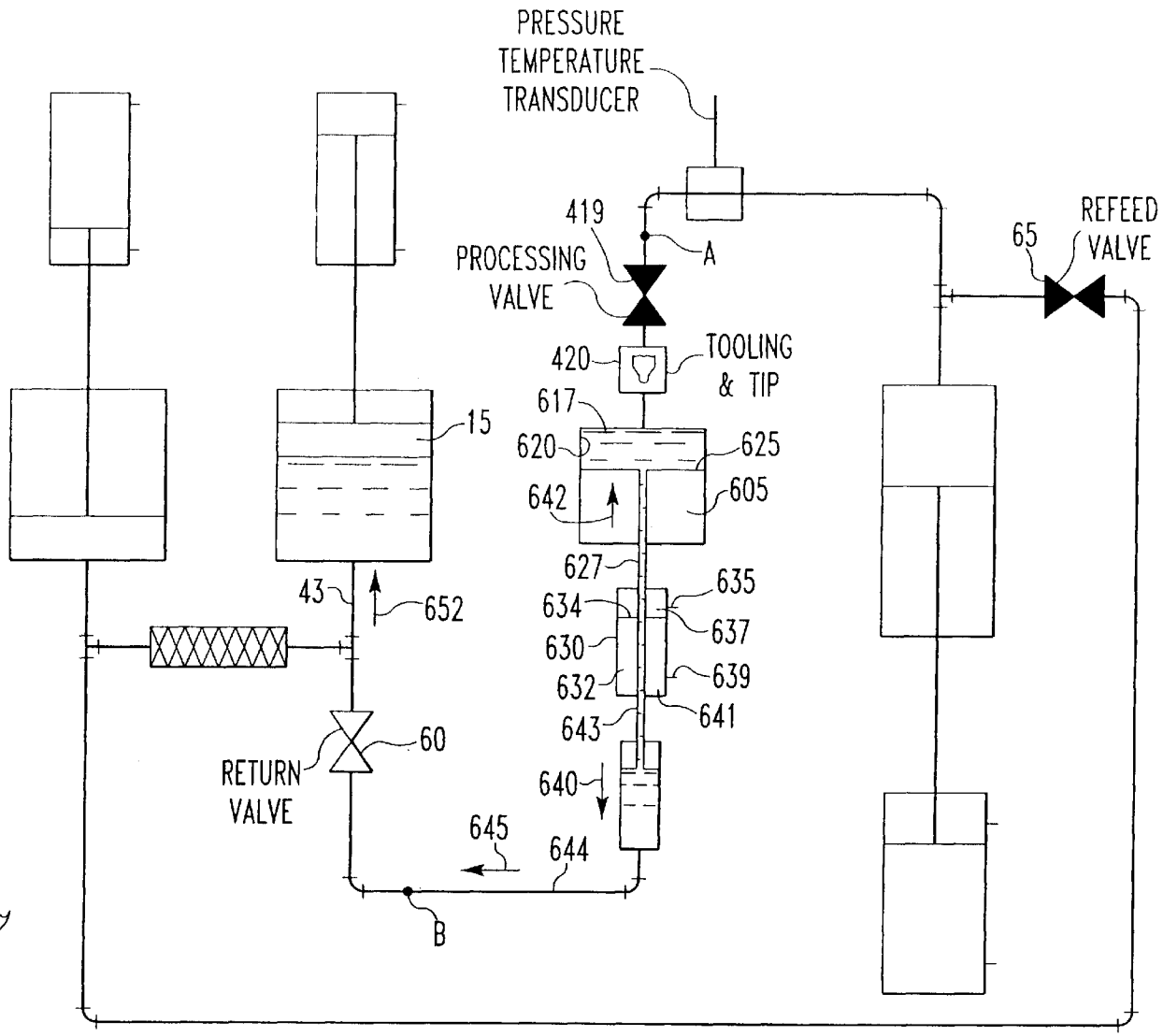
FIG. 7 is a schematic drawing of the returning mode, in accordance with the subject invention.
Figure 7A:
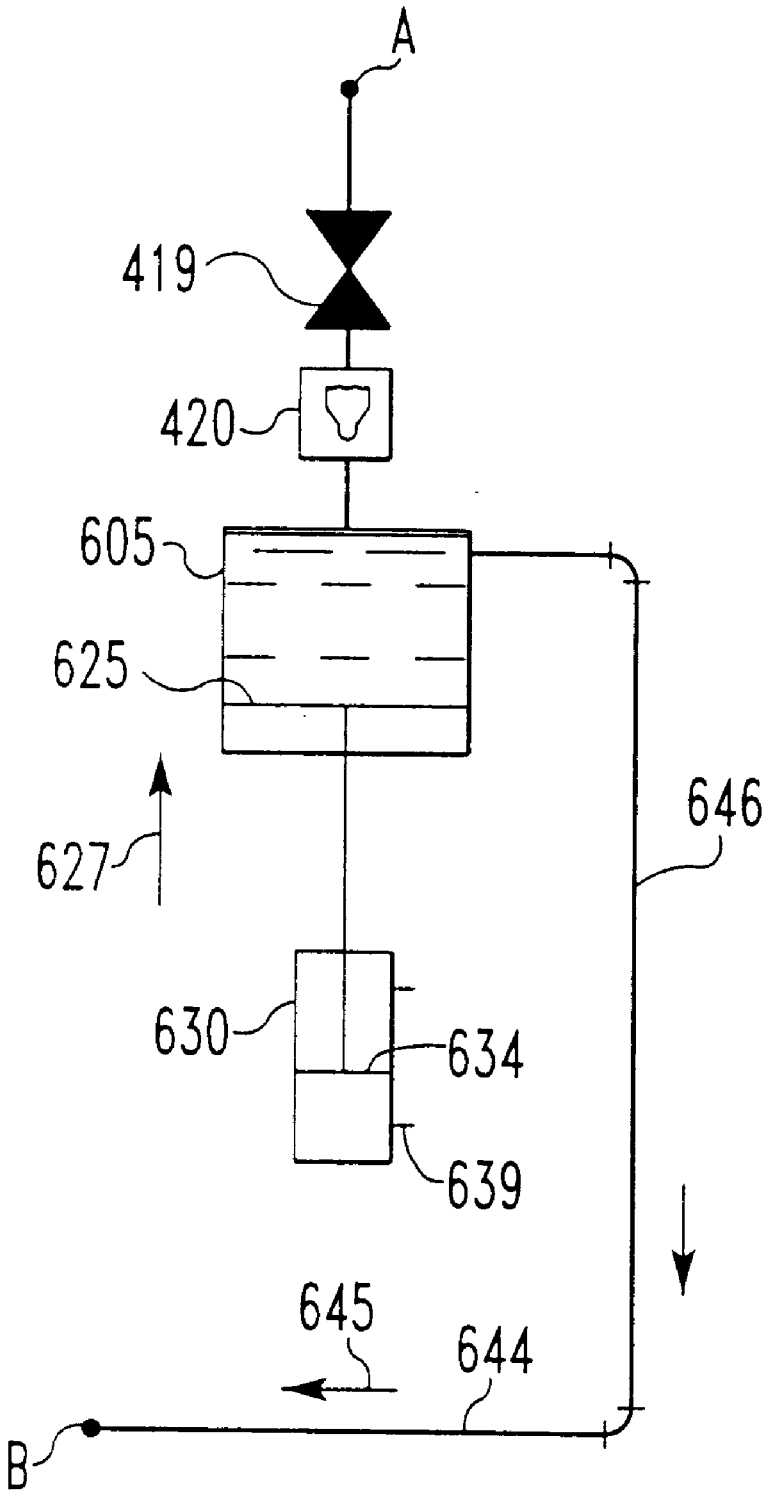
FIG. 7A is a schematic drawing of an alternate embodiment for the returning mode and is a modification between points A and B in FIG. 7.

Directing attention to FIG. 7, the return cylinder 605 has an inner bore 617 and a cylinder wall 620. A piston 625 is within the cylinder wall 620 and attached to the piston 625 is a piston rod 627. The piston rod 627 is driven by actuator 630, wherein the actuator 630 has an actuator cylinder 632 and an actuator piston 634 therein, attached to the piston rod 627. Pressurized fluid entering a hydraulic line 635 into a first chamber 637 urges the actuator piston 634 in one direction indicated by arrow 640, while pressurized fluid through hydraulic line 639 into a second chamber 641 urges the piston 634 in a second direction. The second direction of the piston is indicated by arrow 642, and this motion forces the media through a piston rod bore 643, extending through the center of the piston rod 627. By doing so and with return valve 60 in the open position, the media is positively displaced from the return cylinder 605 to the piping segment 644, as indicated by arrow 645. Additionally, processing valve 419 and refeed valve 65 should be closed. A lower tool plate 426 is urged against a spacer 424 which rests against an upper tool plate 422 to enclose the workpiece 420. The media travels from piping segment 644 toward the return valve 60 (FIG. 7). The media then travels past the return valve 60 in the direction of arrow 652 to join piping segment 43 and travels into the first primary conditioning cylinder 15. FIG. 7A shows an alternative embodiment of the return cylinder arrangement illustrated between points A and B in FIG. 7. In this embodiment, the piston 625 is urged in the direction of arrow 627 by hydraulic fluid introduced in hydraulic line 639 of actuator 630. The piston 625 positively displaces the media upwardly within the return cylinder 605 into a piping segment 646 in the direction indicated by arrow 645 and into piping segment 644.

At this point, the conditioning station 10, processing station 300, and return station 600 have been described with respect to the schematic drawings.

FIGS. 8–14 describes an actual embodiment of the subject apparatus and will now be examined in detail using, wherever possible, previously introduced reference numerals to describe like items.

Directing attention to FIGS. 8, 9, 10, and 11, with initial focus upon FIG. 8, actual hardware previously described in the schematics from FIGS. 3–7 will be described.

Figure 8:
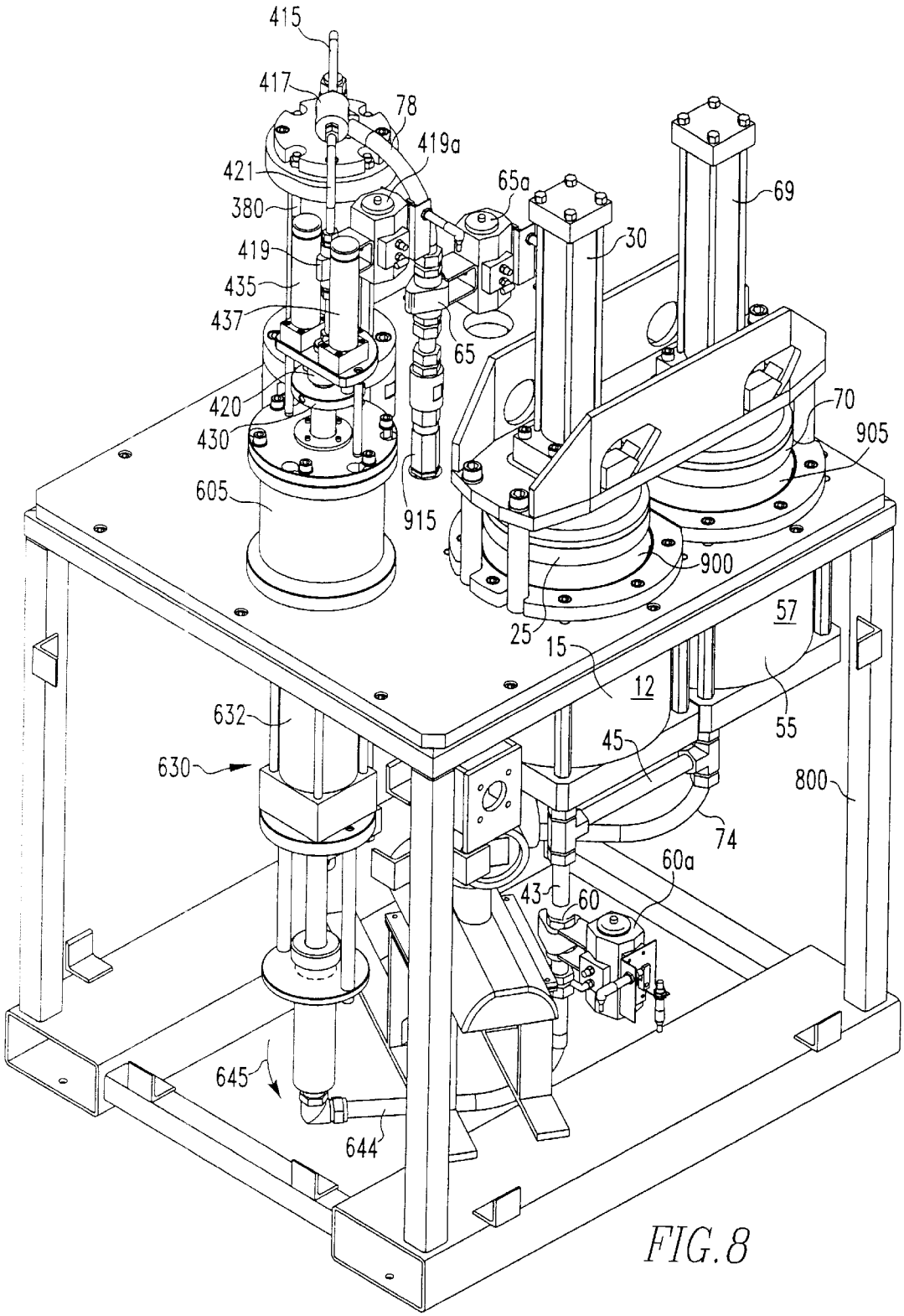
FIG. 8 is an isometric view of the abrasive-flow machining apparatus, in accordance with the subject invention.

In FIG. 8, media may be introduced to primary conditioning cylinder 15 of the first conditioning pump 12 or primary conditioning cylinder 55 of the second conditioning pump 57 via a gap 900 or 905 present when the primary conditioning piston 25 or primary conditioning piston 70, respectively, is in a fully retracted position. Although throughout the assembly drawings these pistons will be shown in the retracted position, it should be appreciated that they are capable of reciprocating within their respective cylinders, as previously described.

With media in the conditioning cylinder 15 and the conditioning cylinder 55, the actuators 30 and 69 may begin to reciprocate the pistons 25, 70 back and forth, such that the media is forced back and forth through the mixer 45. These components generally comprise the conditioning station 10 previously described.

Once the media has been properly conditioned, refeed valve 65 is opened via the refeed valve actuator 65*a*, such that media travels through piping segment 74, upward to a filter 915, past the refeed valve 65, through piping segment 78, where it is introduced into the process cylinder 380. The filter 915 is an in-line filter to remove solid contaminants having a particle size greater than that of the abrasive particles. In particular, abrasive particles may have a size of approximately 10 microns while the filter may remove particles as small as 50–100 microns. Once the process cylinder 380 is charged, the piston 395 (FIG. 6) of the processing cylinder 380 is advanced, thereby forcing media through piping segment 415, past the pressure/temperature transducer 417, past the process valve 419, which is controlled by actuator 419*a*, and through the orifice of the workpiece 420. Note the general vicinity of the workpiece 420 is indicated in FIG. 8. However, in this view, the workpiece 420 is not visible. These components generally describe the processing station 300.

Once the media passes through the workpiece 420, it is collected in the return cylinder 605, where the actuator 630 moves a piston 625 (not shown) within the return cylinder 605 to urge the media in the direction of arrow 645 through piping segment 644. During this stage, the return valve 60, which is controlled by actuator 60*a*, is in the open position, such that the media may readily flow into conditioning cylinder 15 via piping segment 43. These components generally describe the return station 600.

Figure 9:
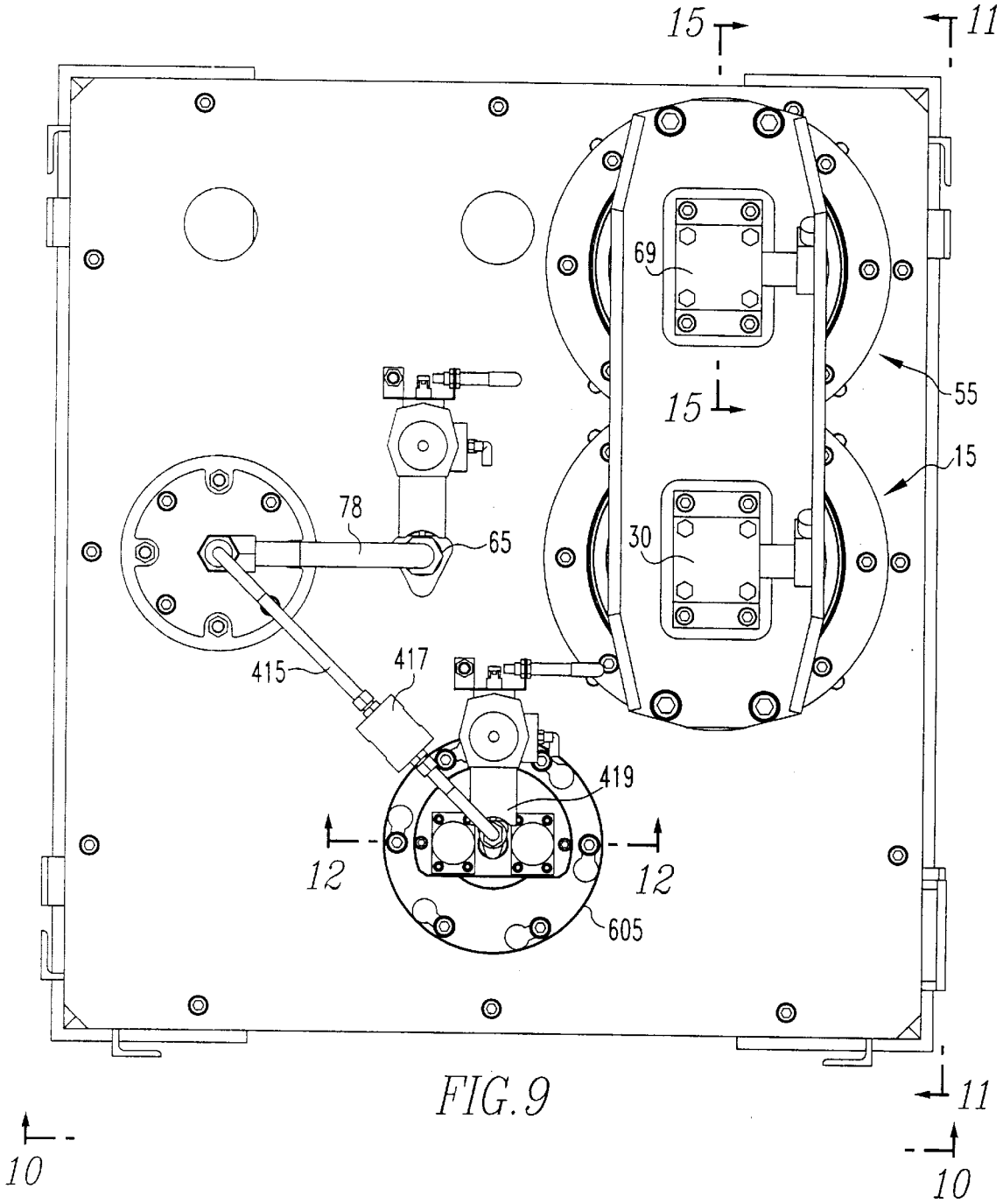
FIG. 9 is a top view of the apparatus shown in FIG. 8.
Figure 10:
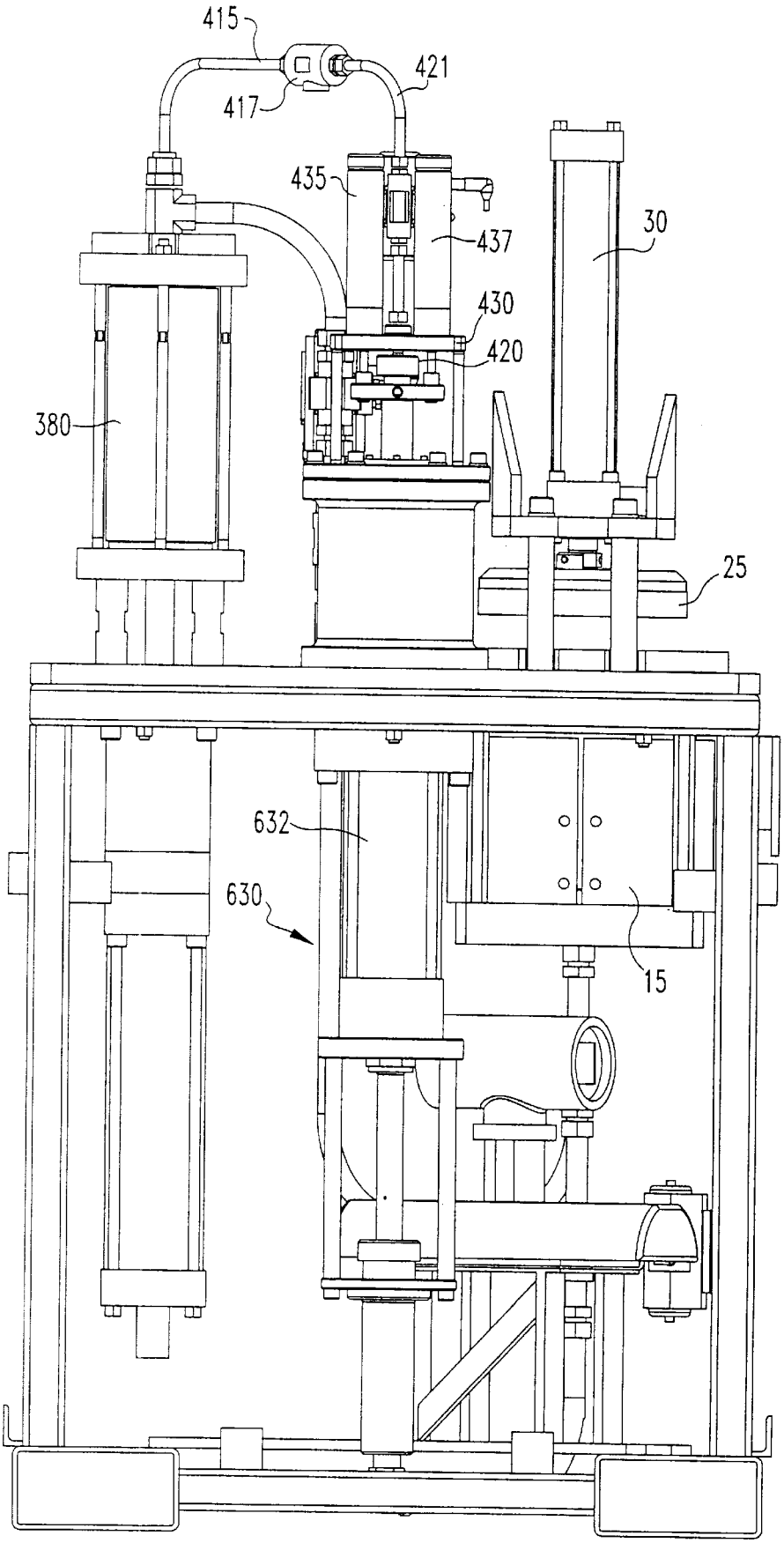
FIG. 10 is a view along arrows 10—10 in FIG. 9.
Figure 11:
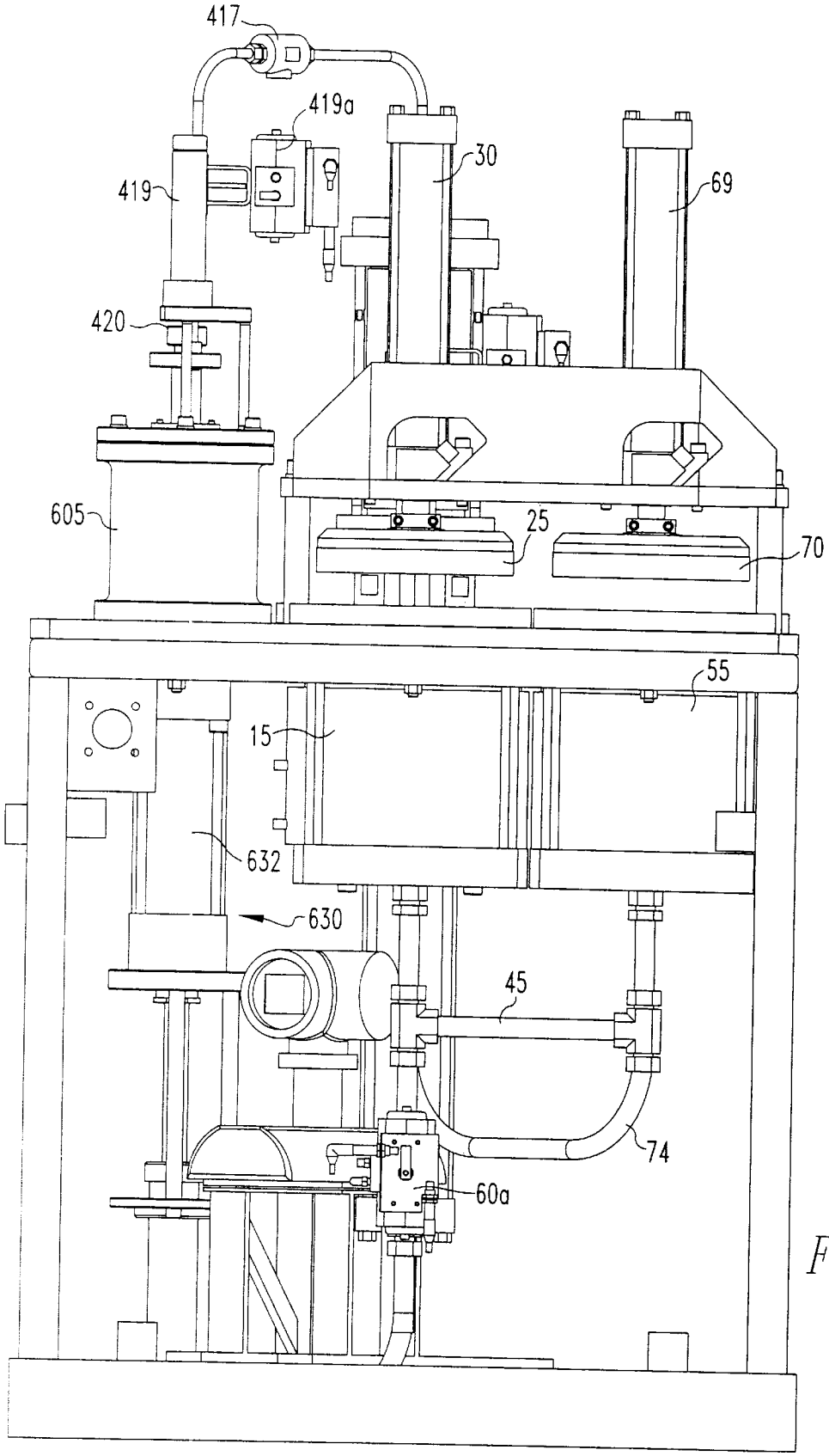
FIG. 11 is a view along arrows 11—11 in FIG. 9.

FIGS. 9, 10 and 11 show different isometric views of the apparatus illustrated in FIG. 8 and like reference numerals have been used in these figures.

Figure 12:
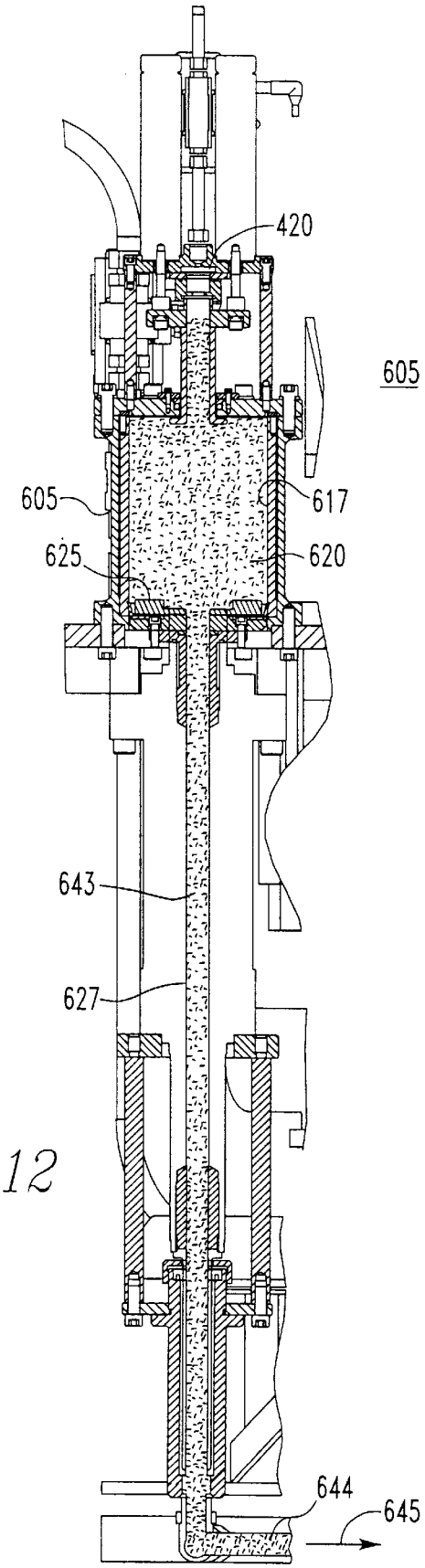
FIG. 12 is a section view along arrows 12—12 in FIG. 9.
Figure 13:
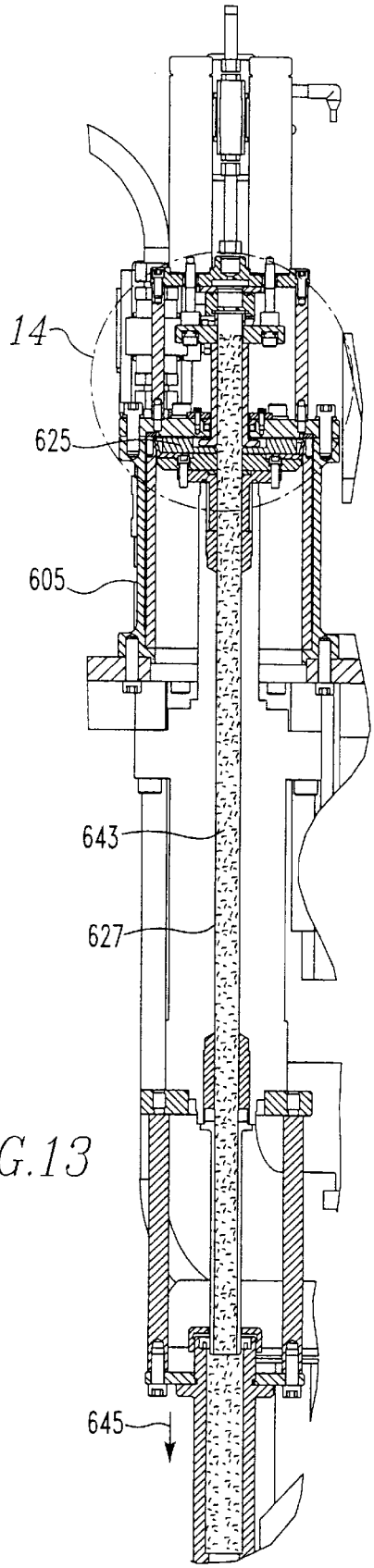
FIG. 13 is a view identical to that of FIG. 12, but with the piston in an extended position.

FIGS. 12 and 13 illustrate details of the return cylinder 605 and the extreme positions of pistons 625 used to transport the media from the return cylinder 605 to the conditioning cylinder 15 (not shown). In particular, with respect to FIG. 12, when the media has traveled through the orifice of the workpiece 420 and accumulated within the return cylinder 605, the piston 625 is moved by the actuator, as previously described, upwardly within the return cylinder 605, such that the media is forced through the piston rod bore 643 of the piston rod 627 as illustrated in FIG. 13. For purposes of illustration, media has been sketched into the cylinder 605 and into the piston rod bore 643 to highlight the path of the media.

Figure 14:
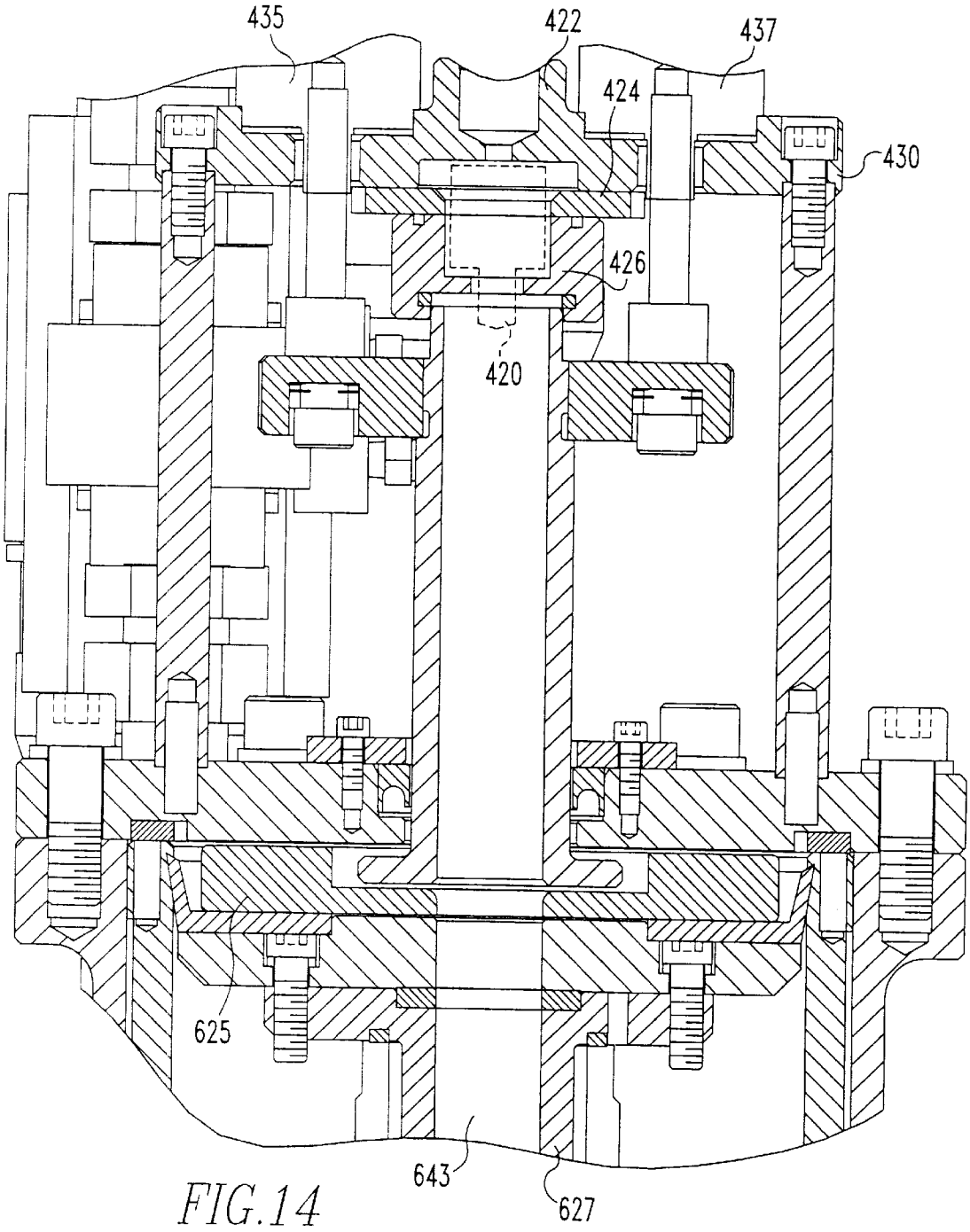
FIG. 14 is an enlarged portion of detail 14, illustrated in FIG. 13.

Directing attention to FIG. 14, the workpiece 420 is secured when the lower tool plate 426 is urged against a spacer 424 which is adjacent to the upper tool plate 422. The lower tool plate 426 is moved vertically from an unsecured position to a secured position by hydraulically actuated clamping cylinders 435, 437. The clamping cylinders 435, 437 engage the lower tool plate 426, thereby urging it to form a seal against the spacer 424 and the upper tool plate 422 to surround and secure the workpiece 420. While clamping cylinders 435 and 437 are indicated as being hydraulically operated, they may also be electrically operated.

It was previously mentioned that the purpose of this invention is to provide an abrasive-flow machine capable of processing both high-viscosity and low-viscosity media. While the device so far described is utilized to process low-viscosity media, the device, with very simple modifications, may be converted to process high-viscosity media. In particular, in order to process high-viscosity media, the primary conditioning cylinders 15, 55 must be resized such that their actuators 30, 69 are capable of producing a high pressure within the respective cylinders. This is accomplished by modifying the primary conditioning cylinder 15 and primary conditioning cylinder 55, such that they have a smaller effective diameter CD' (FIG. 4). Consistent with this, the pistons 25, 70 associated with these cylinders must also be reduced to accommodate the new cylinder size.

Figure 15:
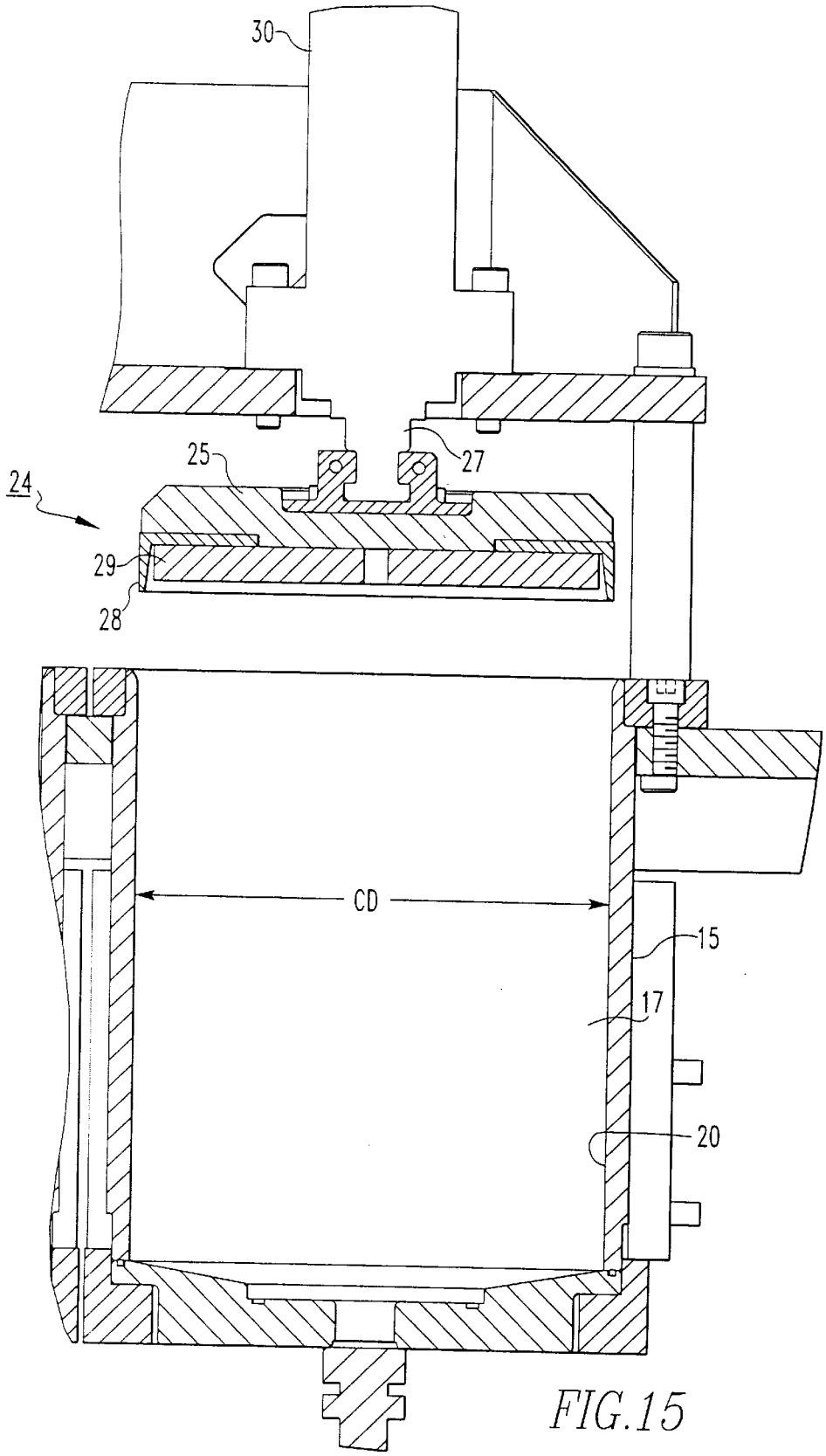
FIG. 15 is a sectional view of a conditioning cylinder along arrows 15—15 in FIG. 9.

Directing attention to FIG. 15, conditioning cylinder 15 is illustrated with an inner bore 17 and a cylinder wall 20 and associated piston assembly 24 having a piston rod 27 connected to a primary conditioning piston 25. A piston seal 28 is secured to the primary conditioning piston 25 with a piston cap 29. Bore diameter CD is indicated.

Figure 16:
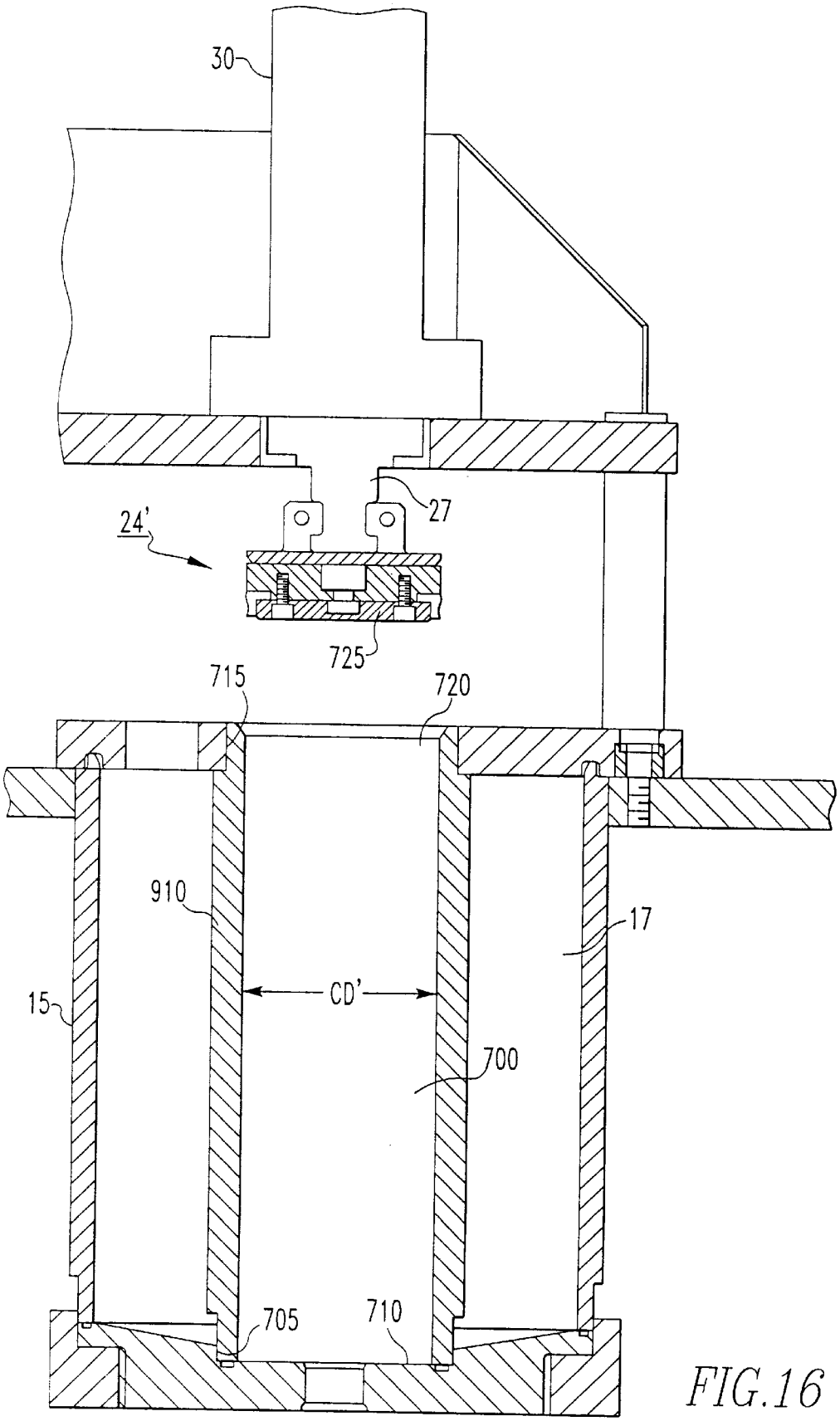
FIG. 16 is a sectional view similar to FIG. 15 but illustrating a manner in which the effective diameter of the cylinder may be reduced.

In order to generate a greater pressure utilizing the same actuator 30, a sleeve 910, as illustrated in FIG. 16, is introduced within the cylinder bore 17, thereby reducing the effective diameter to CD' and providing an alternate conditioning cylinder 700. The sleeve 910 may fit against the wall 705 of a matching bore 710 within the bottom of the primary cylinder 15 and may be secured against the wall 715 of another matching bore 720 on the top of the primary cylinder 15. However, it should be appreciated any number of different designs are available to secure the sleeve 910. The piston assembly 24' replaces piston assembly 24 (FIG. 15) and has a reduced diameter to accommodate the reduced bore CD' thereby providing an alternate conditioning piston 725. As illustrated, the associated hardware is also being reduced in size to accommodate the new effective bore CD'. In such a fashion, the same force produced by the actuator 30 on the piston rod 27 may be utilized with a modified piston assembly 24' to generate a higher pressure within the orifice of alternate cylinder 700. In the alternative, it is entirely possible to replace the actuator 30 with an actuator capable of producing a greater force. However, one characteristic of using high-viscosity media is that a lower volume is used and, therefore, although a higher-force actuator 30 could be utilized, the larger diameter CD of the bore 17 would provide a volume that would not be necessary for a high-viscosity media. In the alternative, rather than introducing a sleeve having a smaller diameter, it is entirely possible to completely replace the primary conditioning cylinder with a completely different alternate cylinder and piston having a smaller diameter.

As an example, using a low-viscosity media in order to generate pressures between 75–150 psi, the diameter CD of such a primary conditioning cylinder 15 could be 10 inches. In the alternative, when using a high-viscosity media to generate pressures in excess of 150 psi, in the range of approximately 800 psi, the effective diameter CD' may be approximately 6 inches. Just as the primary conditioning cylinder 15 has been modified to provide a smaller a effective diameter and thereby providing an alternate conditioning cylinder 700, so, too, may the primary processing cylinder 380 to provide an alternate processing cylinder.

Figure 17:
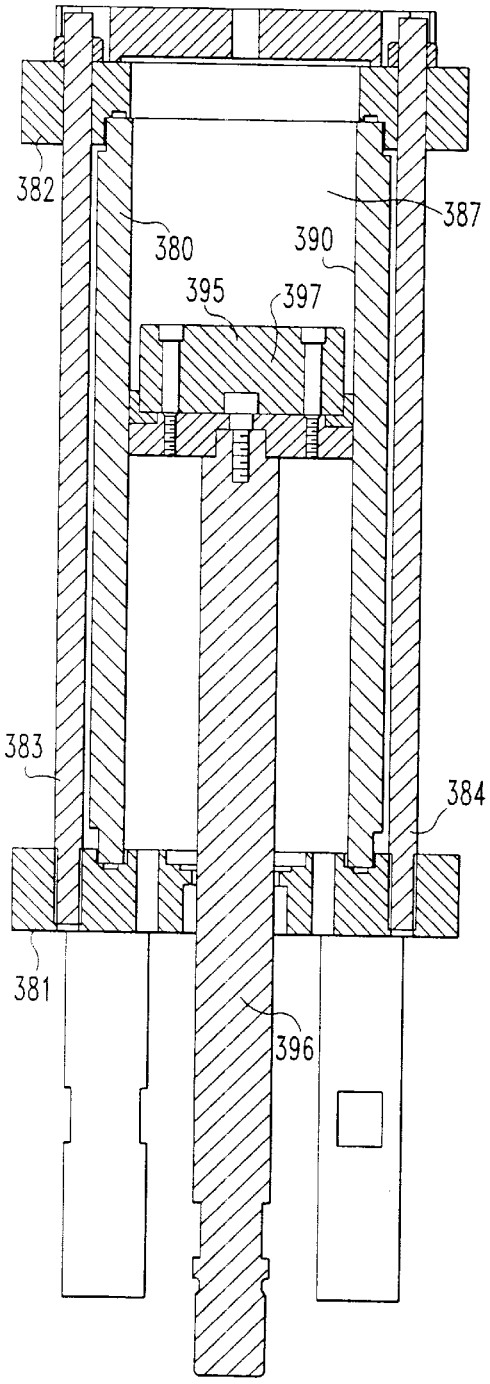
FIG. 17 is a sectional view of one processing cylinder.

The primary processing cylinder 380, on the other hand, must be capable of producing up to 1,500 psi for low-viscosity media, and this would require an effective diameter of approximately 4 inches within the bore of the primary processing cylinder 380. Directing attention to FIG. 17, and as previously discussed with FIG. 5, the processing cylinder 380 of the processing pump (shown as 385 in FIG. 5) is comprised of an inner bore 387 having a cylinder wall 390. A processing piston 395 with a piston rod 396 attached thereto defining a piston assembly 397 extends against the cylinder wall 390 within the bore 387. The piston rod 396 is connected to an actuator (shown as 400 in FIG. 5). The processing cylinder 380 is secured between a lower plate 381 and an upper plate 382 by tie rods 383,384 which are threadably secured to the lower plate 381 and the upper plate 382. The plates 381,382 may have grooves which engage the ends of the cylinder 380.

Figure 18:
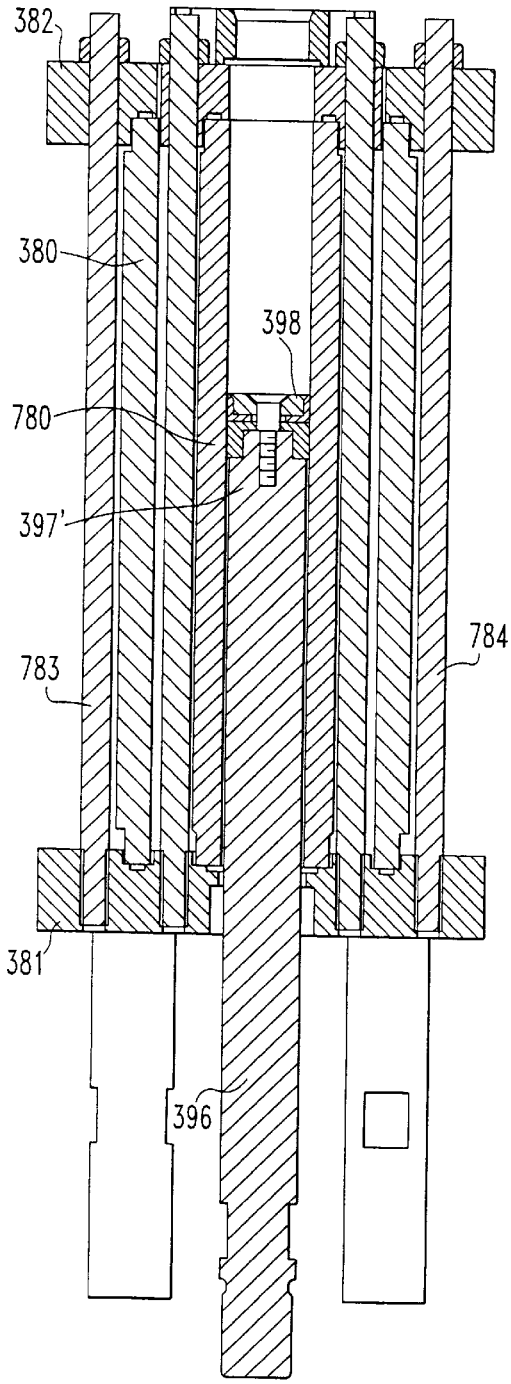
FIG. 18 is a sectional view of a modified processing cylinder with a reduced diameter.

Furthermore, when working with a high-viscosity media, pressures up to 4,000 psi may be required and therefore, using the same actuator, the inner diameter of the processing cylinder may be 2 inches or less. This may be accomplished by completely replacing the primary processing pump 385 comprised of a primary processing cylinder 380 and piston 397 with an alternate processing pump comprised of an alternate processing cylinder and piston having a smaller diameter or, in the alternative and as illustrated in FIG. 18, by introducing a sleeve 780, within the cylinder bore 387, thereby reducing the effective diameter. The sleeve 780 may be secured between the lower plate 381 and the upper plate 382 by tie rods 783,784 threadably secured to the lower plate 381 and to the upper plate 382. The plates 381,382 may have grooves which engage the ends of the sleeve 780. However, it should be appreciated any number of different designs are available to secure the sleeve 780. The piston assembly 397 (FIG. 17), must also be reduced to accommodate the reduced bore of the sleeve 780 (FIG. 18) of the modified piston assembly 397'. As illustrated in FIG. 18, the associated hardware of the piston assembly 397' is reduced to provide an alternate processing piston 398 to accommodate the bore of the sleeve 780. In such a fashion, the same force produced by the actuator on the piston rod 396 may be utilized with a modified piston assembly 397' to generate a higher pressure within the bore.

As previously mentioned, when using an abrasive-flow machine and low-viscosity media, a constant pressure is applied to the media and the flow is monitored through the bore of a nozzle to be processed until the flow reaches a target flow rate, at which time the process is discontinued. In the alternative, the flow rate may be fixed and the pressure monitored until a target pressure is reached, at which time the process is discontinued. Low-viscosity media, in general, requires a larger volume to complete a process. On the other hand, the abrasive-flow machine just described may be adapted, with minor modifications, to accept a high-viscosity media by modifying the effective diameter of the conditioning cylinders and the effective diameter of the processing cylinder. During processing using high-viscosity media, accurate control of the volume, along with constant pressure or constant flow rate, is utilized, and a smaller volume of media is required.

There are a variety of ways to monitor flow rate of low-viscosity media. A flow device may be positioned in the hydraulic fluid flow of the processing cylinder actuator 404. Alternatively, a position feedback sensor may be used to directly measure piston velocity. The pressure/temperature transducer 417 accurately measures the pressure and the temperature upstream of the workpiece, and the temperature and pressure may be used together with the flow rate to control the process.

With high-viscosity media, the mixer 45 is used in conjunction with the conditioning cylinder 15 and conditioning cylinder 55 to impart shear to the media, to provide a homogeneous media, and to maintain a constant media viscosity. However, it should be appreciated that this viscosity is dependent upon the temperature of the media and, therefore, thermal management of the media may be necessary. In general, thermal management requires removing heat from the media, since the media is heated by friction as it passes through the mixer and, furthermore, the media is heated as it travels through the orifice of the nozzle during the processing step. Additionally, it may be necessary to heat the media to a desired temperature. For that reason, a heat exchange device, such as coils, may be placed around or within one or both of the conditioning cylinders 15, 55, or around the processing cylinder 380. It should be appreciated that a heat exchange device may be placed in any of the piping segments in the apparatus. The conditioning and processing cylinders are areas that may be appropriate to position such a heat exchange device. Additionally, a heat exchange device may also be associated with the return cylinder 605. The heat exchange device or devices should be capable of closely controlling the temperature of the media and in certain instances the necessary temperature control may be between +/−0.5 degrees centigrade.

The control of the actuators and valves to configure the abrasive machining apparatus to different operational modes is accomplished using automatic controls known by those skilled in the art of controlling systems with automatic controls.

Associated with the cylinders into which the media flows are bleed valves that relieve pressure or vacuum, thereby permitting the desired flow of media.

What has just been described is an abrasive-flow machining apparatus capable of processing with a low-viscosity media and with minor modifications, capable of processing with a high-viscosity media, thereby providing a range of possible applications for the subject abrasive-flow machining apparatus. It should be appreciated that, while the discussion has so far been directed to low-viscosity media and high-viscosity media, the subject invention, through the selective manipulation of the conditioning cylinder and processing cylinder, may be adapted to accommodate a media having any of a wide number of viscosities between the low-and high-viscosity ranges previously described. By consolidating two abrasive-flow machining apparatuses into one, not only are there significant cost savings but there is a significant reduction of space occupied by such equipment.

The pumps discussed herein have been positive displacement piston pumps. Other positive displacement pumps, such as diaphragm pumps may also be used, however, piston pumps are preferred.

While the processing of only a single workpiece has been discussed, it should be appreciated that, with minor modifications, the subject invention is capable of processing multiple workpieces.

The invention has been described with reference to the preferred embodiments. Obvious modifications and alterations will occur to others upon reading and understanding the preceding detailed description. It is intended that the invention be construed as including all such modifications and alterations insofar as they come within the scope of appended claims or the equivalents thereof.

We claim:

1. A system for abrasive flow machining an orifice in a workpiece wherein the system is capable of using an abrasive media having a range of viscosity values, wherein the system is comprised of:

a) a processing station comprised of a primary processing pump, an alternate processing pump and a processing pump actuator to drive one of either the primary processing pump or the alternate processing pump, wherein one of the primary processing pump or the alternate processing pump is supplied with the media and wherein that pump forces the media from an upstream side of the processing station through the workpiece orifice to a downstream side of the processing station to machine the orifice and wherein when the abrasive media has a low viscosity the primary processing pump is utilized and when the abrasive media has a high viscosity the alternate processing pump is utilized;

i) wherein the primary processing pump is comprised of a primary processing piston and a primary processing cylinder, wherein the primary processing piston has a diameter and wherein the primary processing piston is slidingly positioned within the primary processing cylinder; and ii) wherein the alternate processing pump is comprised of an alternate processing piston and an alternate processing cylinder, wherein the alternate processing piston has a different diameter than the primary processing piston diameter and wherein the alternate processing piston is slidingly positioned within the alternate processing cylinder, and b) a return station for receiving media from the downstream side of the processing station and returning the media in the direction of the upstream side of the processing station, wherein the return station is comprised of a receptacle to collect the media upon discharge from the orifice of the workpiece and wherein the return station is further comprised of a return pump and a return pump actuator for pumping the media in the direction of the upstream side of the processing station.

2. The system according to claim 1 further including a conditioning station for conditioning the media prior to introduction to the processing station wherein the conditioning station is comprised of:

a) a first conditioning pump comprised of a conditioning piston and a conditioning cylinder pair from one pair selected from the group consisting of i) a primary conditioning piston and a primary conditioning cylinder, wherein the primary conditioning piston has a primary diameter and wherein the primary conditioning piston is slidingly positioned within the primary conditioning cylinder and ii) an alternate conditioning piston and an alternate conditioning cylinder, wherein the alternate conditioning piston has an alternate conditioning cylinder with an alternate diameter smaller than Me primary diameter and wherein the alternate conditioning piston is slidingly positioned within the alternate conditioning cylinder and b) a mixer which receives media from the first conditioning pump and mixes the media to impart shear and/or provide homogeneity to the media.

3. The system according to claim 2 wherein the primary conditioning cylinder or the alternate conditioning cylinder is used to create a vacuum to return media to the conditioning cylinder.

4. The system according to claim 1 wherein the return pump a return pump cylinder and return pump piston slidingly therein, wherein the return pump piston provides a seal over an area of the return pump cylinder such that extending the return pump piston displaces the media in the direction of the extension.

5. The system according to claim 1 wherein the return pump has a return pump cylinder and a return pump piston slidingly therein, wherein the return pump piston provides a seal over an area of the return pump cylinder and has a bore extending therethrough such that extending the return pump piston displaces the media in a direction opposite the direction of the extension.

6. The system according to claim 2 further including a second conditioning pump attached in series to the mixer and then to the first conditioning pump such that media may be pumped back and forth through the mixer between the first conditioning pump and the second conditioning pump prior to introduction of the media to the processing station.

7. The system according to claim 1 wherein the abrasive medium may be selected from medium having a viscosity of between one to one million centipoise.

8. The system according to claim 1 further including temperature controllers for controlling the media temperature.

9. The system according to claim 2 further including temperature controllers for controlling the media temperature, wherein the temperature controllers are comprised of cooling collars surrounding the conditioning cylinder.

10. The system according to claim 2 wherein cooling cellars surround one of either the primary processing cylinder or the alternate processing cylinder.

11. The system according to claim 8 wherein the temperature controllers are selected from among a group of controllers capable of maintaining a temperature of the media within ±0.5 degrees centigrade.

12. The system according to claim 1 wherein the mixer comprises a container with one or more baffles to impart shear to the media for controlling viscosity in high viscosity media and for stirring the media to impart homogeneity to low viscosity media.

13. A system for abrasive flow machining an orifice of a workpiece wherein the system is capable of using abrasive media having a range of viscosity values between 1 and 1,000,000 centipoise, wherein the system has a) a conditioning station comprised of a mixer and a conditioning pump, wherein the conditioning pump provides media to the mixer, b) a processing station supplied by the conditioning station wherein the processing station is comprised of a primary processing pump, an alternate processing pump and a processing pump actuator wherein one of either the primary processing pump or the alternate processing pump is supplied with media from the conditioning pump and wherein that processing pump forces media through the orifice of the workpiece to machine the orifice, and c) a return station between the processing station and the conditioning station for returning the media from the processing station to the conditioning station, wherein the return station is comprised of a receptacle to collect media upon discharge from the orifice of the workpiece and wherein the return station is further comprised of a return pump and a return pump actuator for pumping media to the conditioning station, d) wherein the primary processing pump is comprised of a primary processing cylinder and associated primary processing piston and wherein the primary processing pump is changeable with the alternate processing pump comprised of an alternate processing cylinder and an associated alternate processing piston having a different diameter to optimize operation for high viscosity or low viscosity media.

14. A method of adapting a system used for abrasive flow machining with an abrasive media having a viscosity for forcing the media through an orifice of a workpiece so the system may accommodate different media having different viscosities, wherein the method is comprised of the steps of:

a) providing a processing station comprised of a primary processing pump, an alternate processing pump and a processing pump actuator and wherein the primary processing pump has a primary processing pump cylinder and a primary processing pump piston with a primary piston diameter slidably positioned within the primary processing pump cylinder for forcing the media from the processing station through the orifice, and wherein the alternate processing pump has an alternate processing pump cylinder and an alternate processing pump piston with an alternate piston diameter different than the primary piston diameter slidably positioned within the alternate processing pump cylinder for forcing the media from the processing station through the orifice, b) installing one of the primary processing pump or the alternate processing pump suitable for processing media having a particular viscosity, and c) removing the installed pump and installing the other pump suitable for processing media having a different viscosity.

15. The method according to claim 14 wherein the device is further comprised of a conditioning station for mixing the abrasive media through a mixer and wherein the conditioning station has a conditioning pump with a conditioning piston and a conditioning cylinder and the method further includes the step of selecting the diameter of the conditioning cylinder and conditioning piston to accommodate media of different viscosities.

16. The method according to claim 15 wherein the conditioning pump is comprised of a primary conditioning cylinder and a primary conditioning piston and the step of selecting the diameter of the conditioning piston cylinder and the conditioning piston is comprised of replacing the primary conditioning piston cylinder and the primary conditioning piston with an alternate conditioning piston cylinder and an alternate conditioning piston having a smaller diameter.

17. The method according to claim 15 further including the step of transferring heat to or from the media to maintain a desired temperature.

18. The method according to claim 17 further including a return cylinder to collect media upon discharge from the orifice wherein the heat is transferred to or from the media when the media is in the return cylinder.

19. The method according to claim 17 wherein the heat is transferred to or from the media when the media is in the conditioning cylinder.

20. A system for abrasive flow machining an orifice in a workpiece wherein the system is capable of using abrasive media having a range of viscosity values, wherein the system is comprised of:

a) a processing station having a processing pump and a processing pump actuator to drive the pump, wherein the pump is supplied with media and wherein the pump forces media through the workpiece orifice to machine the orifice and wherein the pump is comprised of one from the group consisting of:

i) a primary processing piston and a primary processing cylinder, wherein the primary processing piston has a diameter and wherein the primary processing piston is slidingly positioned within a primary processing cylinder and ii) an alternate processing piston and an alternate processing cylinder, wherein the alternate processing piston has a diameter different than the primary processing piston diameter and wherein the alternate processing piston is slidingly positioned within the alternate processing cylinder, b) wherein the processing pump utilizes the primary processing piston and primary processing cylinder for pumping a low viscosity media through the orifice and utilizes the alternate processing piston and alternate processing cylinder for pumping a higher viscosity media through the orifice, c) wherein the diameter of the primary processing piston is greater than the diameter of the alternate processing piston, and d) wherein the alternate processing cylinder is comprised of a sleeve insertable within the primary processing cylinder and wherein the alternate processing piston is slidably positioned within the sleeve.

21. A system for abrasive flow machining an orifice in a workpiece wherein the system is capable of using abrasive media having a range of viscosity values, wherein the system is comprised of:

a) a processing station having a processing pump and a processing pump actuator to drive the pump, wherein the pump is supplied with media and wherein the pump forces media through the workpiece orifice to machine the orifice and wherein the pump is comprised of one from the group consisting of:

i) a primary processing piston and a primary processing cylinder, wherein the primary processing piston has a diameter and wherein the primary processing piston is slidingly positioned within a primary processing cylinder and ii) an alternate processing piston and an alternate processing cylinder, wherein the alternate processing piston has a diameter different than the pry processing piston diameter and wherein the alternate processing piston is slidingly positioned within the alternate processing cylinder, b) wherein the processing pump utilizes the primary processing piston and primary processing cylinder for pumping a low viscosity media through the orifice and utilizes the alternate processing piston and alternate processing cylinder for pumping a higher viscosity media through the orifice and c) a conditioning station for conditioning the media prior to introduction to the processing station wherein the conditioning station is comprised of i) a conditioning pump comprised of a processing piston and a processing cylinder pair from one pair selected from the group consisting of A) a primary conditioning piston and a primary conditioning cylinder, wherein the primary conditioning piston has a primary diameter and wherein the primary conditioning piston is slidingly positioned within the primary conditioning cylinder and B) an alternate conditioning piston and an alternate conditioning cylinder, wherein the alternate conditioning piston has an alternate conditioning piston with an alternate diameter smaller than the primary diameter and wherein the alternate conditioning piston is slidingly positioned within the alternate conditioning cylinder and d) a mixer which receives media from the pump and mixes the media to impart shear and/or provide homogeneity to the media, and e) wherein the alternate conditioning cylinder is comprised of a conditioning sleeve insertable within the primary conditioning cylinder and the alternate conditioning piston is slidably positioned within the conditioning sleeve.

22. A method of adapting a system used for abrasive flow machining with an abrasive media having a viscosity for forcing the media through an orifice of a workpiece so the system may accommodate different media having different viscosities, wherein the device has a processing station comprised of a processing pump and a processing pump actuator and wherein the processing pump has a primary processing pump cylinder and a primary processing pump piston with a primary diameter slidably positioned within the primary cylinder for forcing the media from the processing station through the orifice, wherein the method is comprised of the steps of:

a) determining the diameter of the primary processing pump cylinder and the primary processing piston to accommodate media of different viscosities; and b) inserting a sleeve within the primary processing piston cylinder and replacing the primary processing piston with an alternate processing piston having a smaller diameter.

23. A method of modifying a device used for abrasive flow machining with an abrasive media having a viscosity for forcing the media through an orifice of a workpiece, wherein the device has a processing station comprised of a processing pump and a processing pump actuator and wherein the processing pump has a primary processing pump cylinder and a primary processing pump piston with a primary diameter slidably positioned within the primary cylinder for forcing the media from the processing station through the orifice and wherein the device has a conditioning station for mixing the abrasive media through a mixer and wherein the conditioning station has a conditioning pump with a primary conditioning piston and a primary conditioning cylinder, wherein the method is comprised of the steps of:

a) determining the diameter of the primary processing cylinder and the primary processing piston to accommodate media of different viscosities; and b) inserting a sleeve within the primary processing cylinder and replacing the primary processing piston with an alternate processing piston having a smaller diameter, c) modifying the diameter of the primary conditioning cylinder and primary conditioning piston to accommodate media of different viscosities by inserting a sleeve within the primary conditioning piston cylinder; and d) replacing the primary conditioning piston with an alternate conditioning piston having a smaller diameter.

* * * * *

UNITED STATES PATENT AND TRADEMARK OFFICE

CERTIFICATE OF CORRECTION

PATENT NO. : 6,500,050 B2 
DATED : December 31, 2002
INVENTOR(S) : William L. Walch et al.

It is certified that error appears in the above-identified patent and that said Letters Patent is hereby corrected as shown below:

Column 8,
Lines 54-55, "a smaller a effective" should read -- a smaller effective --.

Column 11,
Line 47, "than Me primary" should read -- than the primary --.
Line 59, "pump a return" should read -- pump has a return --.

Column 12,
Lines 20-21, "cooling cellars" should read -- cooling collars --.

Column 14,
Line 35, (a)(ii), "than the pry" should read -- than the primary --.

Signed and Sealed this

Twelfth Day of August, 2003

JAMES E. ROGAN
*Director of the United States Patent and Trademark Office*